United States Patent [19]

Humphrey

[11] 4,369,814

[45] Jan. 25, 1983

[54] FLEXIBLE TUBULAR JOINT

[75] Inventor: Kenneth M. Humphrey, Fleet, England

[73] Assignee: Underwater and Marine Equipment Limited, Farnborough, England

[21] Appl. No.: 229,071

[22] Filed: Jan. 28, 1981

[30] Foreign Application Priority Data

Nov. 27, 1980 [GB] United Kingdom ..... 8038023

[51] Int. Cl.[3] ..... F16L 11/18

[52] U.S. Cl. ..... 138/120; 285/11; 138/155; 2/2.1 R

[58] Field of Search ..... 138/120, 155; 285/11, 285/263, 166, 331; 2/2.1 R; 60/592

[56] References Cited

U.S. PATENT DOCUMENTS 1,888,026 11/1932 Chapman ..... 285/11

1,947,657 2/1934 Peress ..... 285/11

FOREIGN PATENT DOCUMENTS 1524033 9/1978 United Kingdom ..... 138/120

1526400 9/1978 United Kingdom ..... 138/120

*Primary Examiner*—James E. Bryant, III

*Attorney, Agent, or Firm*—Charles A. Brown

[57] ABSTRACT

A joint which may be used in a diving suit includes a plurality of annular members each having a piston and cylinder portion which are coupled together whereby the connecting members are connected in series. The piston and cylinder portions define chambers which are filled with oil and each connecting member has valves which enable communication of the oil between adjacent connecting members as the joint is flexed. A slidably anchored gimbal mounting is provided for each valve in order to preserve the flexibility of the joint without impeding valve action and in order to prevent pullout of the adjacent piston and cylinder portions. The piston and cylinder portions each include inner and outer annular walls and the inside surfaces of the annular walls of the cylinder portions are spherically curved. The annular walls terminate in respective circular rims which are oppositely staggered. This facilitates assembly on the annular connecting members. A further arrangement ensures that the oil chambers in the serial chain on connecting members each receive an adequate supply of oil.

28 Claims, 7 Drawing Figures

2
3
4
5
7
8
20
25
30
31

1a
1b
1a
12d
1a
1b
5a
4
7
1
16
1
12c
1
5
11
27
9
10
8
11
7
9
8'
8
22
23
25
17
7
1a
19
20
21
24
26
8
11
1'
10

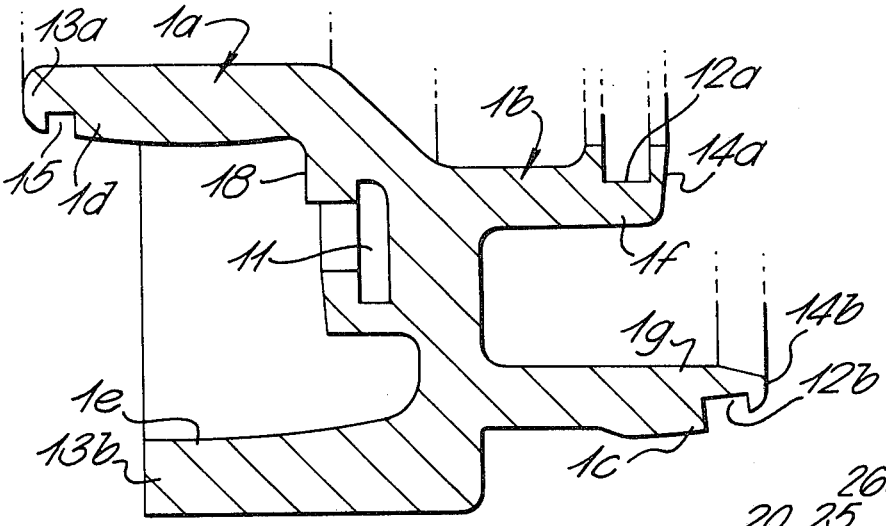
FIG. 3.
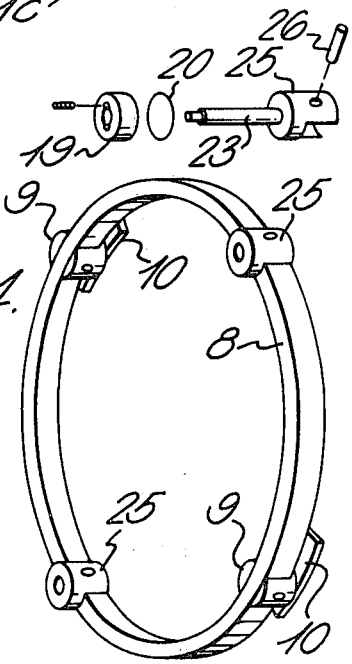
FIG. 4.
FIG. 5.
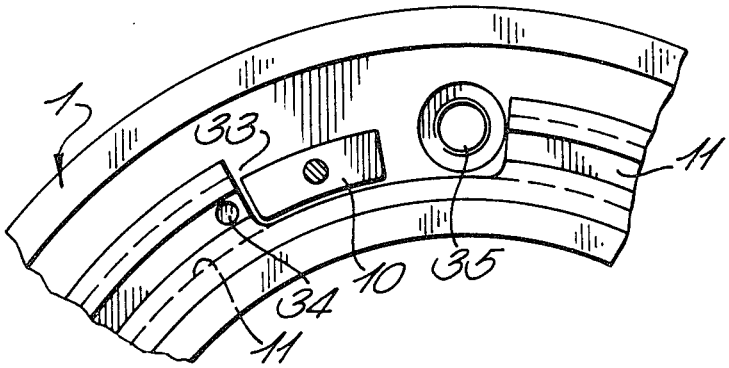

FLEXIBLE TUBULAR JOINT

This invention relates to a flexible tubular joint for joining together two tubular members, particularly in situations in which a differential pressure exists between the inside of the tubular members and a surrounding medium. An example of such a situation is a case in which the tubular members are parts of an atmospheric pressure diving suit and are submerged at depth.

Reference is made to our U.K. Pat. No. 1524033 which describes a flexible tubular joint comprising a pair of annular end members connected together by a plurality of annular connecting members connected in series. Each pair of adjacent connecting members has a coupling therebetween comprising an annular piston slidably located within an annular cylinder which contains a substantially incompressible fluid. According to one embodiment, the connecting members are substantially identical and each comprises an annular cylinder portion and an annular piston portion. Each pair of adjacent connecting members are coupled together by locating the piston portion of one connecting member in the cylinder portion of the next adjacent connecting member. Each cylinder portion is defined by spherically curved side-walls which define a chamber containing the incompressible fluid, such as oil. Each piston portion has sealing means which are in slidable contact with the side-walls of the respective cylinder portion.

Reference is also made to our U.K. Pat. No. 1526400 which describes an articulated joint in which means are provided for replacing fluid lost from a cylinder due to a wiping action along the cylinder walls. Such means may be employed with the flexible joint describe in U.K. Pat. No. 1524033 to make up any loss of fluid or oil from the chambers between the piston and cylinder portions of adjacent connecting members.

As described in our U.K. Pat. No. 1526400, means may be provided for replacing fluid, such as oil, which is lost due to the wiping action which takes place on relative movement of the piston and cylinder portions.

The oil is present in a series of chambers which exist between the annular piston and cylinder portions of each pair of adjacent connecting members arranged in a serial chain. The oil may be transferred axially of the joint, for example, in a direction from a shoulder member towards an elbow member and thence to a hand member, by ports which enable communication from chamber to chamber. However, each connecting member is preferably provided with one or more valves (typically a pair) which close against respective seatings in the floor of the associated cylinder portion to control the flow of oil between adjacent chambers. These valves open when the volume of oil contained within the chambers is reduced (for example, due to inadequate initial filling, compression of air bubbles within the oil, leakage due to lubrication, etc). The oil which is lost (e.g. in the case of leakage) or which needs to be made up (e.g. in the case of inadequate filling or compression of air bubbles) is replenished or supplied by the make-up system described in U.K. Pat. No. 1526400. In the case of using valves to control the flow of oil between the chambers, it is important to ensure that the action of the valves is not impeded by flexure of the joint and vice versa. For example, the inner surfaces of the annular walls of the cylinder portion of each connecting member preferably have a spherical curvature so that the corresponding piston portion, which has annular cylindrical walls, is free to tilt in any direction and to rotate relative the cylinder portion. Thus there is a problem of mounting the valves so that any relative movement between the piston and cylinder portions does not prevent them from opening or closing, and so that the valves do not limit the 'universal' type of coupling of the piston and cylinder portions. There is also a problem of restraining axial expansion of the joint when it is brought up to the surface. When the joint is submerged, the water pressure tends to compress the joint in the axial direction (thereby opening the valves until the designed volume of oil is provided in the respective chambers). As the joint is brought to the surface, the water pressure drops and the connecting members move away from one another thereby closing the valves. On the surface, there is no water pressure, but the weight of each connecting member and of any lower end member (such as a hand manipulator, or elbow member, or both) acts downwardly on the upper connecting members causing the annular piston portions to be withdrawn from the respective annular cylinder portions. Whilst a stop ring can be provided to prevent the piston portion of being pulled out of its cylinder portion, it is considered to be disadvantageous to allow each piston portion to be withdrawn to such an outer limit, having regard to the close sliding tolerances between the piston portions and the spherical walls of the cylinder portions. Therefore, it is desirable to provide some form of restraint to limit the amount of withdrawal of each piston portion from its respective cylinder portions.

According to one aspect of the invention, the latter problems are solved by providing a gimbal mounting for the or each valve in a respective one of said connecting members, the gimbal mounting being slidably anchored in an adjacent one of said connecting members.

The advantages of the latter arrangement are that the gimbal mounting allows flexure of the joint about a spherical centre, i.e. each connecting member can tilt in any direction with respect to its adjacent connecting member, without affecting the operation of the valve or valves, and relative rotation of adjacent connecting members is possible (i.e. about the longitudinal axis of the joint). Each valve is free to open as the joint is axially compressed, due to water pressure when the joint is submerged, but when the joint is brought to the surface, withdrawal of the piston portion from the respective cylinder portion of adjacent connecting members is restrained by the gimbal mounting.

In a preferred arrangement, at least one pair of diametrically opposite valves in a respective one of said connecting members are provided with a respective and common gimbal mounting, which gimbal mounting is slidably anchored in an adjacent one of said connecting members.

In the case where the connecting members are of identical construction, there is also a problem of maintaining the oil volume in the furthest or peripheral chambers, due to the hydraulic resistance of the valves in the serial chain of chambers. If the furthest chambers are starved of oil, the piston and cylinder portions can move axially together (due to external hydrostatic pressure) and this may lead to seizure of the relevant section of the joint.

To overcome the latter problem, the joint can be structured so that the oil pressure is progressively slightly different in the serial chain of oil chambers, the oil pressure being highest in the chamber at the body end (i.e. of the diver's body) and lowest in the chamber at the outer end of a limb. As a result, if a valve in a chamber opens, then oil will flow from the adjacent chamber (where it is at a slightly higher pressure) into the respective chamber so as to make-up the oil volume to a designed amount. The valve will then close. The system thereby acts as a constant volume system whereby the volume of oil in each chamber is maintained at a predetermined value.

In a joint of the type described by U.K. Pat. No. 1524033, a problem can arise when assembling the joint namely, when inserting the annular piston portion of one connecting member into the annular cylinder portion of an adjacent connecting member. In the preferred embodiment, the side walls of the cylinder portion are spherically curved, whereas the side walls of the piston portion are not. The spherically curved walls of the cylinder portion extend away from a diametral plane and thus the inner and outer diameters of the curved side walls are larger in the plane of the diameter of the sphere than in a plane, parallel, to, but spaced from the diametral plane. Although the curvature is gradual, close tolerances are required to ensure a smoothly slidable and leak-free fit and such close tolerances aggravate the difficulty of inserting the annular piston portion into the spherically curved cylinder portion.

According to another aspect of the invention, this problem is overcome by stepping or staggering the circular rims of the walls which define the annular piston and cylinder portions to facilitate assembly with regard to the required tolerances. Sealing rings may be received in respective grooves which are also stepped or staggered with respect to one another on the outer surfaces of inner and outer annular walls of the annular piston portion.

Embodiments of the various aspects of the invention will now be described with reference to the accompanying drawings, in which:

FIG. 3 is an enlarged sectional view of the part of a connecting member used in the joints of FIGS. 1 and 2;

FIG. 4 is a perspective view of a gimbal ring and showing an exploded view of a valve and clevis assembly;

FIG. 5 is a plan view, on an enlarged scale, of part of a connecting member to show how a slipper is fitted into an undercut groove;

Figures 1, 6:
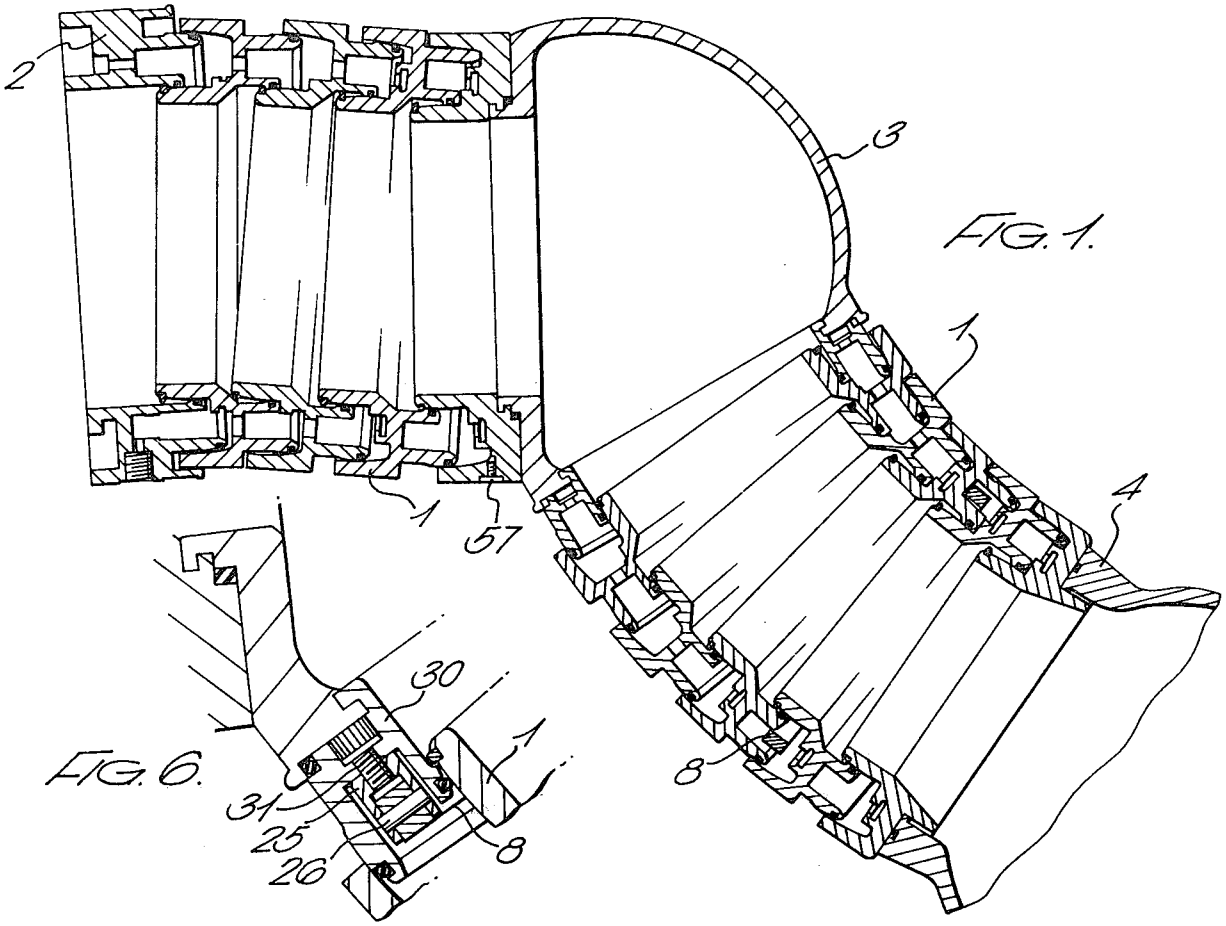
FIG. 1 shows a cross-section through upper and lower arm joints which are connected by an elbow member, of the joints being part of a diving suit (not shown)
FIG. 6 is a view, in cross-section, on an enlarged scale, of an upper part of the lower arm joint shown in FIG. 1.

Referring to FIG. 1, this is provided mainly to show, in a schematic form, the interconnection of connecting members 1 between (a) a shoulder ring 2 and an elbow member 3, and (b) the elbow member 3 and a hand member 4 (valves have been omitted for clarity but a typical ring 8 is shown, see below).

Figure 2:
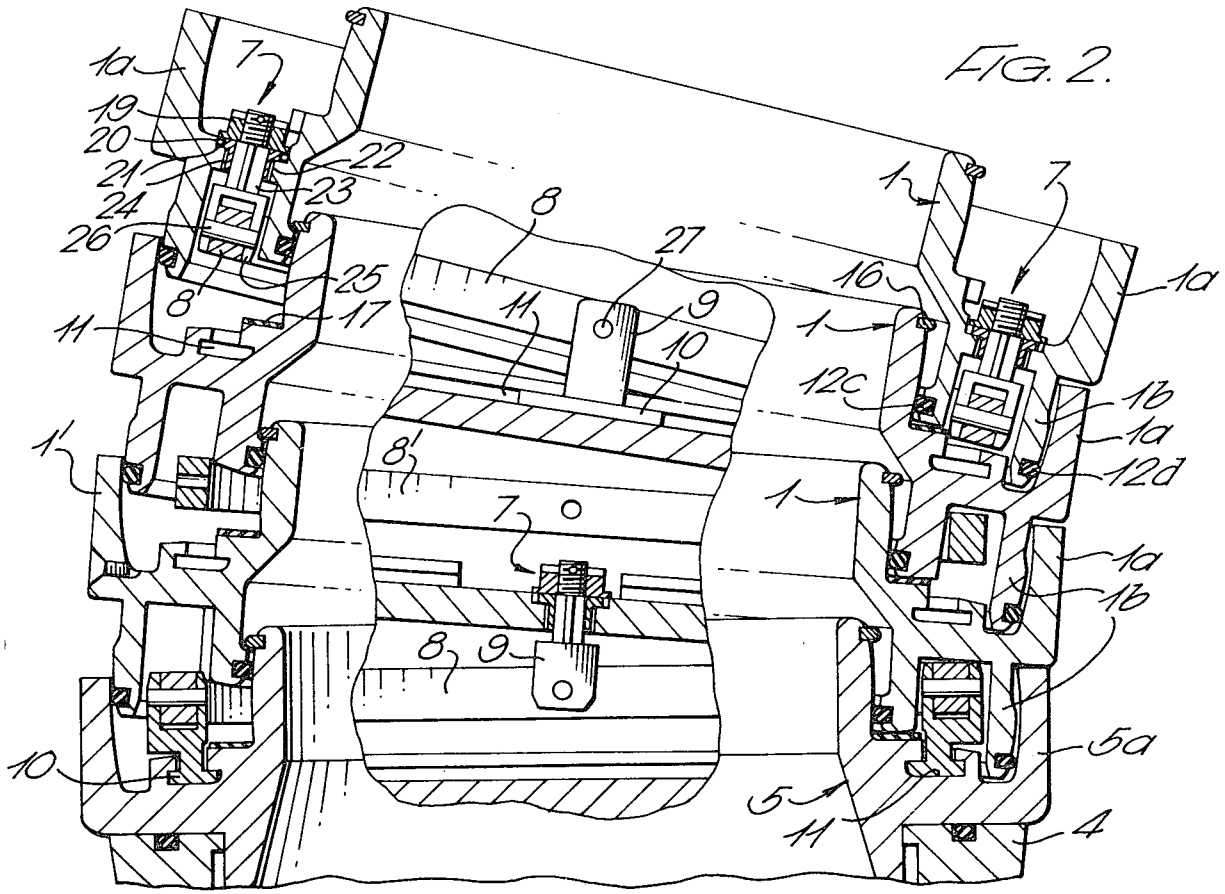
FIG. 2 is an enlargement of a part of the lower arm joint shown in FIG. 1, in cross-section.

The construction of the connecting members 1 is shown on an enlarged scale and in cross-section in FIG. 2. Three connecting members 1 are shown. Each comprises an annular cylinder portion 1*a* and an annular piston portion 1*b*. The piston portion 1*b* of the lower connecting member 1 is received in a cylinder portion 5*a* of a ring 5 received in the hand member 4. FIG. 2 also shows, partly in section, valves 7 which are supported by gimbal rings 8. Each ring 8 is pivotally supported by a clevis 9 (one on each side of a diameter) which is integral with a pedestal shaped slipper 10. The slipper 10 is slidably located in an undercut circular groove 11 having an inverted T-shaped cross-section. The slipper 10 and groove 11 thereby provide a slidable anchorage to enable relative rotation of adjacent connecting rings 1. Also, as will be explained in detail below, the valves 7 provide an anchorage (preventing disengagement of adjacent piston and cylinder portions 1*a*, 1*b*), but they are pivotally mounted on the gimbal rings 8 and hence relative tilting of adjacent connecting members does not interfere with the operation of the valves 7.

Referring to FIG. 3, this shows the cylinder portion 1*a* and piston portion 1*b* (on an enlarged scale and in cross-section) of a typical connecting member 1. It will be understood that both of these portions are annular, i.e. walls 1*d*, 1*e* of cylinder portion 1*a* and walls 1*f*, 1*g* of piston portion 1*b* are each generally cylindrical. Only a cross-sectional plane is shown in FIG. 3. The inner surface of walls 1*d*, 1*e* are partly spherical to accommodate tilting movement of the piston portion 1*b* of an adjacent connecting member. Walls 1*f*, 1*g* of the piston portion 1*b* are cylindrical but part of an outer face 1*c* of wall 1*g* is inclined by an angle of about 5° with respect to the inner surface of wall 1*g*. The outer walls of the piston 1*b* are also provided with grooves 12*a*, 12*b* to receive sealing rings 12*c*, 12*d* (shown in FIG. 2). The piston portion 1*b* is hollow as best seen in FIG. 3.

The leading edges or circular rims 13*a*, 13*b* of the cylinder portion 1*a* are staggered with respect to one another. Similarly, the leading edges or circular rims 14*a*, 14*b* of the piston portion 1*b* are stepped or staggered. As will be apparent from FIG. 2, the piston portion 1*b* of a connecting member 1 is received in the cylinder portion 1*a* of the adjacent connecting member 1. The stepping or staggering of the circular rims of the cylinder and piston portions facilitates assembly of the joint as shown in FIG. 2, having regard to the close tolerances required to provide a smoothly slidable and leak-free fit.

A circular groove 15 is provided on the inner surface of wall 1*d* of the cylinder portion 1*a* to receive an abutment or stop ring 16 (shown in FIG. 2) to prevent excess relative tilting movement of the connecting members. Also, as shown in FIG. 2, a circular resilient rings 17 is located on shoulder 18 (FIG. 3) within the cylinder portion 1*a* to cushion abutment of the circular rim 14*a* of the corresponding piston portion 1*b*.

Referring to FIG. 2, each connecting member 1 is provided with a pair of the valves 7 arranged diametrically opposite one another. Each valve 7 includes a cap portion 19 which seats on an O-ring 20 located on a shoulder 21 of a bore 22 passing through the floor of the cylinder portion 1*a*. The cap is fast with a stem 23 which has a square cross-section. The corners of the square section are rounded off. The stem passes through a cylindrical insert 24 which is located in the bore 22 and which retains the O-ring 20. The insert 24 has a circular section so that oil can pass therethrough adjacent the surfaces of the square section stem. The stem 23 is fixed to a clevis 25 which is pivotally attached, by means of a pin 26, to the gimbal ring 8. Thus, the valve 7 anchors its connecting member 1 to a lower gimbal ring 8, whilst allowing tilting movement of the connecting member about the axis passing through the diametrically opposite pivot pins 26. The gimbal ring 8 is pivotally mounted on a pair of clevises 9 located diametrically opposite one another. In the upper ring 8 shown in the drawing, only one of these clevises 9 is seen with a pivot pin 27. Each clevis 9 is attached to slipper 10 which is slidably located in the circular groove 11. Thus, each ring 8 is anchored to the adjacent lower connecting member 1, but the upper connecting member is free to tilt about the axis passing through pivot pins 27. The diametral axis of pivot pins 26 is at right angles to the diametral axis of pivot pins 27. This provides the gimbal mounting whereby each connecting member 1 is free to tilt in any direction with respect to its adjacent connecting member. Moreover, the slipper 10 can slide in the circular groove 11 to provide for relative rotation between the connecting members.

For clarity, valves 7 and clevis 9 have been omitted from FIG. 2 almost in the centre of the drawing. This is to show the ring 8' with greater clarity. It will also be noted that the ring 8 which is attached below the lower connecting member 1' is rotated through 90° so that the slippers 11 can be seen, one on either side of the drawing. In this case, the valves 7 appears in the center of the drawing. Member 5 has a cylindrical portion 5*a* which is similar to the cylindrical portion of each connecting member. However, instead of an annular piston portion, it is shaped to fit within the hand member 4 as best seen in FIG. 1.

Referring to FIG. 6, the uppermost connecting member 1 cooperates with a piston portion 30 which is similar to the piston portion of the connecting members. However, instead of a cylinder portion, it is shaped to fit elbow member 3. Also, since valves 7 are not required in member 30, the gimbal ring 8, which is attached to clevis 25 by a pivot pin 26, is attached to a socket headed bolt or screw 31 which secures clevis 25 to member 30.

The gimbal ring 8 and the pivotal mountings are also shown in FIG. 4. The upper inset exploded diagram illustrates the components of the valve 7. The slippers 10 have an arcuate form as shown also in plan view in FIG. 5. FIG. 5 also shows a cut-out portion 33 which enables the slipper 10 to be located in the circular groove 11 as described above. After inserting the slipper 10 a pin 34 is attached to prevent the slipper from leaving one end of the groove 11. An abutment 35 is also provided to prevent the slipper from leaving the other end of the groove 11. The abutment 35, seen in FIG. 5, is at the end of 1 of two almost semicircular grooves which are provided to receive respective slippers 10.

Figure 7:
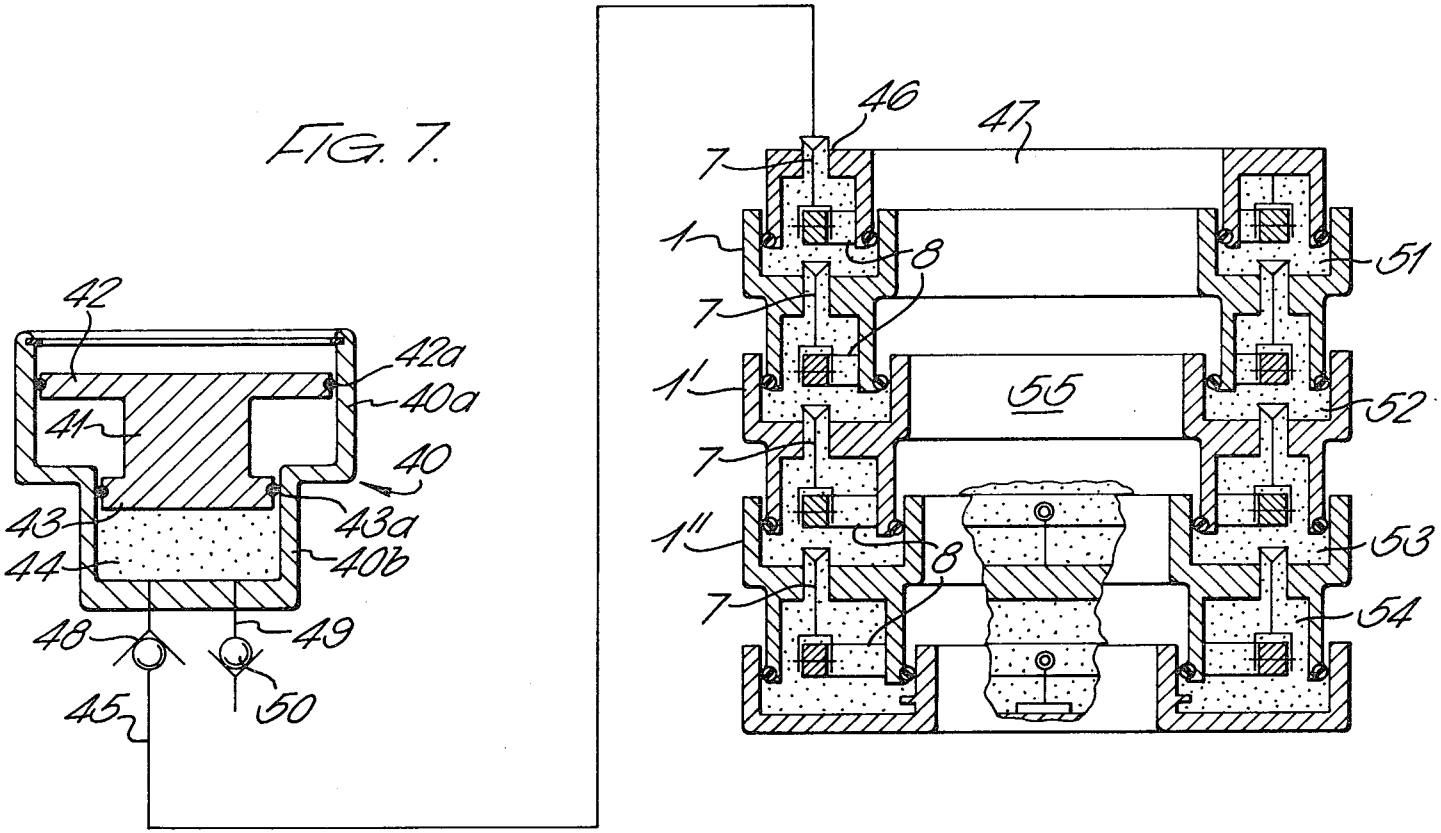
FIG. 7 is a schematic view of a joint connected to an oil make-up system.

FIG. 7 schematically illustrates a joint comprising a plurality of connecting members 1, the joint communicating with a stepped cylinder 40 of an oil make-up system. The cylinder 40 houses a differential piston 41 having lands 42, 43 provided with respective sealing rings 42*a*, 43 rings 42*a*, 43*a* are in slidable contact with the walls of upper and lower cylinder portions 40*a*, 40*b* respectively. Portion 40*a* is a larger cross-section is open to enable sea water pressure to act on land 42. The lower cylinder portion 40*b* is a smaller cross-sectional area and is enclosed so as to contain an incompressible fluid 44, such as oil. When cylinder 40 is submerged, sea water pressure acts on land 42 and the differential piston 41 moves to compress the oil 44 in the lower cylinder portion 40*b*. The arrangement may be such that the oil pressure is 2.25 times the ambient water pressure.

The lower cylinder portion 40*b* communicates, by means of a pipe 45 with a port 46, closed by valves 7, in an upper ring 47 of the flexible joint. A non-return valve 48 is connected between pipe 45 and the lower cylinder portion 40*b* to prevent any back-flow of oil from the joint to the cylinder 40. The cylinder portion 40*b* is charged with oil via a filler pipe 49 which is connected to a non-return valve 50 to prevent any out-flow of oil from the cylinder 40.

The connecting members 1, 1' 1'' shown in FIG. 7 have increasingly larger dimensions. More particularly, the cross-sectional area of the piston and cylinder portions are progressively larger in the direction from member 1 towards member 1''. Oil chambers between cooperating piston and cylinder portions have been numbered 51, 52, 53 and 54 on the right-hand side of the joint. The dimensions of the connecting members may be such that the pressures in the chambers are as follows:

| Chamber No. | Oil Pressure in terms of ambient water pressure |
|---|---|
| 51 | 2.21 |
| 52 | 2.17 |
| 53 | 2.13 |
| 54 | 2.09 |

The interior 55 of the joint and an annular chamber 56 surrounding the differential piston 41 of the oil make-up system are both filled with air at or about atmospheric pressure.

As the joint and the cylinder 40 are submerged, the differential piston 41 exerts a pressure on the oil 44 in the cylinder 40 as mentioned above. The water pressure also compresses the joint causing the connecting members 1 to move towards each other, i.e. to cause the piston portions to move within the cylinder portions. As the valves 7 of each connecting member are secured to the gimbal ring 8 which is anchored to a lower adjacent connecting member, the valves 7 open and the oil flows from the lower cylinder portion 40*b* into each of the chambers 51–54. The valves close when the volume of oil in the respective chambers reaches a designed value. The values would then normally remain closed but the arrangement is such that the valves 7 open if the designed value of fluid volume in the respective chambers decreases due to leakage (e.g. due to the wiping action between the piston and cylinder portion of adjacent connecting members during articulation of the joint) and this allows fluid to flow from an adjacent chamber upstream of any valve, or from the oil make-up system, into the respective chamber with a depleted volume. When the designed value of fluid volume is achieved, the respective valve closes. When the suit is brought to the surface, the valves 7 tend to close as the hydrostatic pressure is relieved, adjacent connecting members tend to move apart. This movement if unchecked, could lead to the point where the piston portion is pulled out of the cylinder portion. However the gimbal mountings (described above) restrain excess extension of the piston and cylinder portions of each of the connecting members and thereby avoid the problem mentioned above.

Referring to FIG. 1, a bore (not shown) communicates with the oil chambers on each side of the elbow member 3. The oil chambers on each side of the elbow member 3 are thus in a serial connection. The uppermost oil chamber in the joint between the shoulder ring 2 and the elbow member 2 communicates, through a similar tapped bore (not shown), with the oil make-up system shown in FIG. 7. Tapped bores 57 are also provided, which are normally closed by plugs, to enable bleeding of the oil system during filling.

The invention is not limited to the type of connecting members illustrated in the drawings and comprising a piston portion at one end and a cylinder portion at the other. For example, alternate connecting members 1 may have oppositely directed cylinder portions, the adjacent (and alternate connecting members) having oppositely directed piston portions. Furthermore, the arrangement may be such that one valve only allows communication of the incompressible fluid or oil between adjacent chambers. Moreover, the seating for the valve or valves may be provided in the piston portion, rather than in the floor of the cylinder portion with a consequent rearrangement of the respective valve or valves.

I claim:

1. In a joint of the type comprising a plurality of annular connecting members, one of said members having an annular piston portion, an adjacent one of said members having an annular cylinder portion, said annular piston portion being coupled to said annular cylinder portion whereby adjacent one of said connecting members are connected in series, said annular piston portion and said annular cylinder portion of said adjacent connecting members defining a chamber, substantially incompressible fluid in said chamber, and at least one valve in each of said connecting members forming means for providing communication of said fluid between adjacent chambers; the improvement wherein a gimbal mounting is provided for each valve in a respective one of said connecting members, said gimbal mounting being slidably anchored in an adjacent one of said connecting members.

2. The invention according to claim 1 wherein a pair of diametrically opposite valves are arranged in a respective one of said connecting members, each said pair of valves being provided with a respective and common gimbal mounting slidably anchored in an adjacent one of said connecting members.

3. The invention according to claim 2 wherein each of said gimbal mountings comprises ring means, and pedestal means which are pivotally attached to said ring means across a diameter thereof and substantially at right angles to an axis on which the or each of said valves are located, said pedestal means being slidably located in said adjacent one of said connecting members.

4. The invention according to claim 3 wherein there is provided a circular, undercut recess in the respective one of said connecting members, the recess slidably receiving said pedestal means.

5. The invention according to claim 4 wherein each said pedestal means has a base with an inverted T-shape, the cross-section of said recess being similarly shaped to receive the base of each said pedestal means.

6. The improvement according to claim 5 wherein a section of the circular undercut recess is cut-out to enable fitment of the base of each said pedestal means, stops being provided adjacent the cut-out section to prevent detachment of said pedestal means from said recess.

7. The invention according to claim 3 wherein each said pedestal means has a clevis part in which a portion of said ring means is received, a pin passing through said clevis part and said ring portion to provide said pivotal attachment.

8. The improvement according to claim 1 wherein the cross-sectional area of the piston and cylinder portions of each of said connecting members arranged in a serial chain is progressively larger in an axial direction along said chain, whereby the pressure exerted by said incompressible fluid, due to hydrostatic pressure when the joint is submerged, in any one of said chambers, is progressively lower than that in the preceding chamber in said axial direction.

9. The invention according to claim 4 wherein each said pedestal means has a clevis part in which a portion of said ring means is received, a pin passing through said clevis part and said ring portion to provide said pivotal attachment.

10. The invention according to claim 5 wherein each said pedestal means has a clevis part in which a portion of said ring means is received, a pin passing through said clevis part and said ring portion to provide said pivotal attachment.

11. The invention according to claim 6 wherein each said pedestal means has a clevis part in which a portion of said ring means is received, a pin passing through said clevis part and said ring portion to provide said pivotal attachment.

12. A flexible tubular joint comprising at least a pair of annular connecting members, one of said members having an annular piston portion, an adjacent one of said members having an annular cylinder portion, said annular piston portion being coupled to said annular cylinder portion whereby adjacent ones of said connecting members are connected in series, said annular piston portion and said annular cylinder portion of said adjacent connecting members defining a chamber, substantially imcompressible fluid in said chamber, at least one valve being provided in each of said connecting members forming means for providing communication of said fluid between said adjacent chambers, a gimbal mounting for said valve in a respective one of said connecting members, said gimbal mounting being slidably anchored in an adjacent one of said connecting members.

13. A joint according to claim 12 wherein a pair of diametrically opposite valves are arranged in a respective one of said connecting members, each said pair of valves being provided with a respective and common gimbal mounting slidably anchored in an adjacent one of said connecting members.

14. A joint according to claim 12 or 13 wherein each of said gimbal mountings comprises ring means, and pedestal means which are pivotally attached to said ring means across a diameter thereof and substantially at right angles to an axis on which the or each of said valves are located, said pedestal means being slidably located in said adjacent one of said connecting members.

15. A joint according to claim 14 wherein there is provided a circular, undercut recess in the respective one of said connecting members, the recess slidably receiving said pedestal means.

16. A joint according to claim 15 wherein each said pedestal means has a base with an inverted T-shape, the cross-section of said recess being similarly shaped to receive the base of each said pedestal means.

17. A joint according to claim 16 wherein a section of the circular undercut recess is cut-out to enable fitment of the base of each said pedestal means, stops being provided adjacent the cut-out section to prevent detachment of said pedestal means from said recess.

18. A joint according to claim 13 wherein each said pedestal means has a clevis part in which a portion of said ring means is received, a pin passing through said clevis part and said ring portion to provide said pivotal attachment.

19. A joint according to claim 12 further including a fluid make-up system, said connecting members being arranged in a serial chain, the chamber which contains said imcompressible fluid at a first end of said chain being connected to said fluid make-up system, the cross-sectional area of the piston and cylinder portions of each of said connecting members being progressively larger in an axial direction along said chain and away from said fluid make-up system, whereby the pressure exerted by said imcompressible fluid, due to hydrostatic pressure when the joint is submerged, in any one of said chambers, is progressively lower than in the preceding chamber in said axial direction.

20. A joint according to claim 19 wherein said fluid make-up system comprises stepped cylinder means, differential piston means housed within said cylinder means, said differential piston means having a first end face of major cross-sectional area which is open to an ambient medium when the joint is submerged and having a second end face of minor cross-section which acts on incompressible fluid within a reservoir chamber defined by said cylinder means, said reservoir chamber being connected to said serial chain of connecting members, and said different piston means defining together with walls of said cylinder means a gas tight chamber containing a gas or mixture of gases which are substantially at atmospheric pressure.

21. A joint according to claim 12 wherein each said cylinder portion has inner and outer annular walls, the inside surfaces of said inner and outer walls being spherically curved, each said piston portion having corresponding inner and outer annular walls and being provided with means in slidable and sealing contact with said inside surfaces of said inner and outer walls of the respective cylinder portion, respective leading circular rims of each annular wall of the annular piston and cylinder portions being stepped or staggered with respect to one another to facilitate assembly with regard to the spherical curvature of said inside surfaces and with regard to the required tolerances of said sliding and sealing contact.

22. A joint according to claim 21 wherein outer surfaces of the inner and outer walls of the annular piston portion contain grooves which are stepped or staggered with respect to one another, respective sealing rings being provided in said grooves.

23. A joint according to claim 14 wherein each said pedestal means has a clevis part in which a portion of said ring means is received, a pin passing through said clevis part and said ring portion to provide said pivotal attachment.

24. A joint according to claim 15 wherein each said pedestal means has a clevis part in which a portion of said ring means is received, a pin passing through said clevis part and said ring portion to provide said pivotal attachment.

25. A joint according to claim 16 wherein each said pedestal means has a clevis part in which a portion of said ring means is received, a pin passing through said clevis part and said ring portion to provide said pivotal attachment.

26. A joint according to claim 17 wherein each said pedestal means has a clevis part in which a portion of said ring means is received, a pin passing through said clevis part and said ring portion to provide said pivotal attachment.

27. A flexible tubular joint comprising annular end members, a plurality of annular connecting members, said annular connecting members being connected in series with one another and said series connection being connected to said annular end members, each of said connecting members having an annular piston portion and an annular cylinder portion, said annular piston portion of a preceding one of said annular connecting members being coupled to said annular cylinder portion of an adjacent one of said annular connecting members whereby said annular connecting members are connected in series, each of said cylinder portions having first inner and outer annular walls, inside surfaces of said first inner and outer annular walls being spherically curved, said first inner and outer annular walls also terminating in respective circular rims, each of said piston portions having corresponding second inner and outer annular walls, said second inner and outer annular walls terminating in respective circular rims, said second inner and outer annular walls also being provided with means for making slidable and sealing contact with said inside surfaces of said first inner and outer annular walls of said cylinder portion, said circular rims of said first inner and outer annular walls of said cylinder portion being axially stepped or staggered with respect to one another, said circular rims of said second inner and outer annular walls of said piston portion also being axially stepped or staggered with respect to one another, said axial stepping or staggering of said circular rims of said first inner and outer annular walls being opposite to said axial stepping or staggering of said circular rims of said second inner and outer annular walls whereby assembly of said connecting members in series is facilitated with regard to the spherical curvature of said inside surfaces of said first inner and outer walls of said cylinder portion and with regard to the required tolerances of said sliding and sealing contact.

28. A joint according to claim 27 wherein outer surfaces of the first inner and outer walls of the annular piston portion contain grooves which are stepped or staggered with respect to one another, respective sealing rings being provided in said grooves.

* * * * *